United States Patent [19]

Yoshikawa

[11] Patent Number: 4,656,913

[45] Date of Patent: Apr. 14, 1987

[54] ELECTRONIC MUSICAL INSTRUMENT WITH KEYBOARD AND COVER

[75] Inventor: Yoshimasa Yoshikawa, Hamamatsu, Japan

[73] Assignee: Nippon, Gakki Seizo, Kabushiki Kaisha, Hamamatsu, Japan

[21] Appl. No.: 823,045

[22] Filed: Jan. 27, 1986

[30] Foreign Application Priority Data

Jan. 31, 1985 [JP] Japan ..... 60-11334[U]
Jan. 31, 1985 [JP] Japan ..... 60-11335[U]
Jan. 31, 1985 [JP] Japan ..... 60-11336[U]
Jan. 31, 1985 [JP] Japan ..... 60-11337[U]

[51] Int. Cl.[4] ..... G10C 3/02

[52] U.S. Cl. ..... 84/177; 84/DIG. 3; 84/DIG. 17

[58] Field of Search ..... 84/177, 178, 179, 180, 84/183, DIG. 3, DIG. 17, 228, 251, 252, 452 P

[56] References Cited

U.S. PATENT DOCUMENTS 2,530,251 11/1950 Luberoff ..... 84/177 X
3,608,415 9/1971 Muraki ..... 84/177
4,040,335 8/1977 Oliver et al. ..... 84/183
4,334,453 6/1982 Kumano ..... 84/177
4,593,593 6/1986 Bellini ..... 84/177

OTHER PUBLICATIONS

Japanese Utility Model Publication No. sho 47-11821.

*Primary Examiner*—Michael L. Gellner
*Assistant Examiner*—Brian W. Brown
*Attorney, Agent, or Firm*—Blakely, Sokoloff, Taylor & Zafman

[57] ABSTRACT

An electronic musical instrument with a keyboard has a musical instrument housing with the keyboard and an operation panel arranged adjacent to the keyboard, and a cover for covering the keyboard and the operation panel. Guide projections are formed at two sides of the keyboard and the operation panel of the musical instrument housing. The cover has first and second cover bodies, a first coupling device for coupling the first and second cover bodies in a foldable manner, and a second coupling device for pivotally coupling a rear end portion of the first cover body with the musical instrument housing. The front end portion of the second cover body is guided and slid along the guide projections when the cover is opened or closed. When the cover is open, the outer surface of the second cover body stands facing forward and serves as a music rack.

12 Claims, 11 Drawing Figures

ELECTRONIC MUSICAL INSTRUMENT WITH KEYBOARD AND COVER

BACKGROUND OF THE INVENTION

The present invention relates to an electronic musical instrument with a keyboard and cover such as an electronic organ.

In conventional musical keyboard instruments such as electronic organs, two types of covers for protecting operation panels and keyboards are known: a first type cover pivotally supported at its rear end and opened/-closed along the back-and-forth (i.e., vertical) direction; and a second type cover slidable along the back-and-forth direction and capable of being housed in a musical instrument housing. The first type cover is widely employed in upright pianos. When the cover is open, the inner surface of the upper front board faces forward (i.e., towards the player). A music rack is mounted on the inner surface, and the player places a music piece on the music rack. The second type cover is widely used in electronic organs. It comprises a plurality of cover members bent and coupled in parallel to each other, and can be slid in a straight line or along a curve in the front-and-back direction along guides formed on the inner surfaces of the side arms (i.e., side boards).

Since the first type cover comprises a single member, its structure, manufacture and assembly are simple. In addition, it also serves as a music rack when open. However, the inner surface of the upper front board faces the player when it is open and must thus be finished with the same ornamentation and precision as the outer surface, increasing manufacturing complexity and costs. The first type cover is also heavy, and when the player accidentally lets go of the upper front board while opening or closing it, the board may clamp the player's fingers between the front end portion of the cover and the front lower rail and injure him.

The second type cover, on the other hand, has a large number of parts, and manufacturing and assembly are cumbersome. Furthermore, when the cover is housed in the housing, a separate music rack must be mounted on the housing.

SUMMARY OF THE INVENTION

It is, therefore, a principal object of the present invention to provide an electronic musical instrument with a keyboard and a cover wherein the cover has a simple structure and can be easily handled and special attention need not be paid to the inner surface of the cover.

In order to achieve the above object of the present invention, there is provided a housing assembly of an electronic musical instrument with a keyboard, comprising: a musical instrument housing with the keyboard and an operation panel located adjacent to the keyboard; and a cover for covering the keyboard and the operation panel, the housing assembly further being provided with guides located at two sides of the keyboard and the operation panel of the musical instrument housing, the cover being constituted by first and second cover bodies, a first coupling device for coupling the first and second cover bodies in a foldable manner, and a second coupling device for pivotally coupling a rear end portion of the first cover body with respect to the musical instrument housing, the second cover body being adapted such that a front end portion thereof is moved along the guides while the cover is opened/-closed, and the second cover body being adapted such that an outer surface thereof stands facing forward and serves as a music rack.

DESCRIPTION OF THE PREFERRED EMBODIMENTS

The present invention will be described with reference to the preferred embodiments in conjunction with the accompanying drawings.

Figure 1:
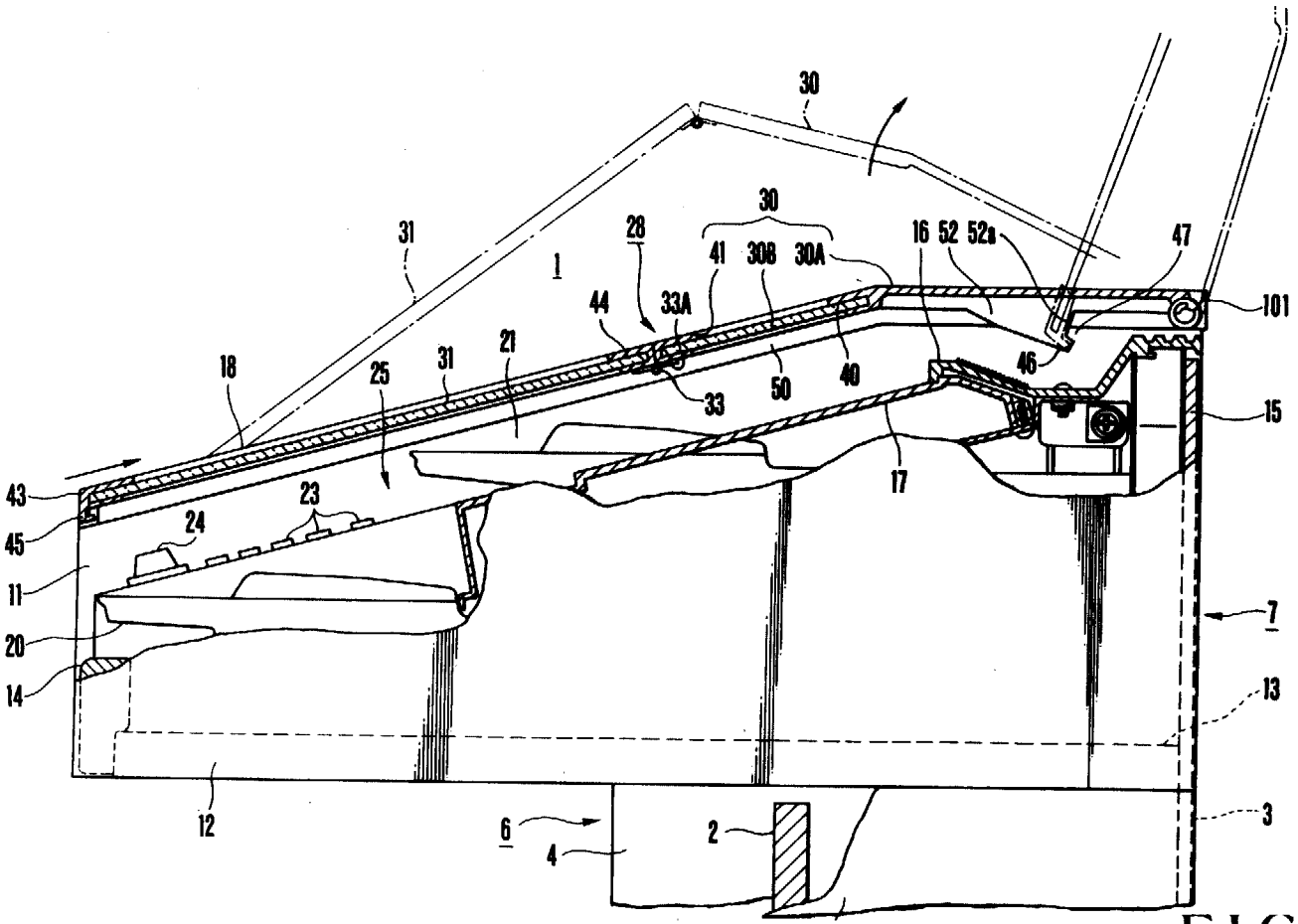
FIG. 1 is a partial sectional side view showing an electronic organ according to an embodiment to which the present invention is applied.
Figure 2:
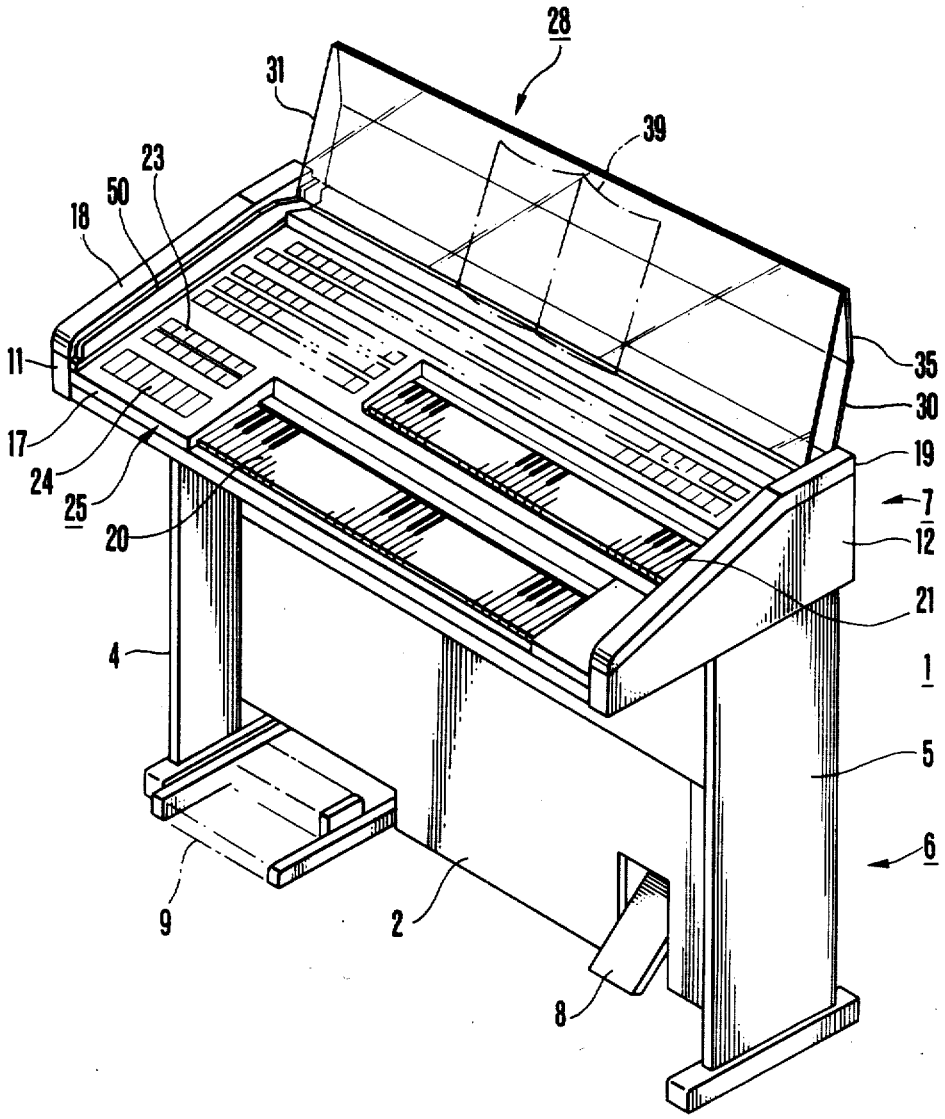
FIG. 2 is a perspective view of the electronic organ shown in FIG. 1.

FIGS. 1 and 2 show a first embodiment wherein the present invention is applied to an electronic organ having a two-step keyboard. Referring to FIGS. 1 and 2, an electronic organ 1 has a box-like housing cabinet 6 extending along the right-and-left direction and a musical instrument housing 7. The housing cabinet 6 consists of a front board 2, a back board 3, left and right side boards 4 and 5, and a bottom board (not shown). The musical instrument housing 7 is fixed on the housing cabinet 6, and the front end of the housing 7 extends toward the front side (i.e., the player side). Different speakers (not shown) are arranged inside the housing cabinet 6. An expression pedal 8 and a number of foot keys 9 are arranged at the lower portion of the front side.

The musical instrument housing 7 has a box-like shape and is constituted by a pair of left and right side boards 11 and 12, a shelf board 13, a lower front rail 14, a back board 15, a panel 16 with a roughened surface, a panel 17 with a front end inclining downward, and a pair of upper covers 18 and 19 respectively fixed to the upper end faces of the left and right side boards 11 and 12. Lower and upper keyboards 20 and 21 and electric parts such as various control buttons 23 and switches 24 are arranged on the surface of the panel 17 to constitute a keyboard section 25. The keyboard section 25 is covered with a foldable keyboard cover 28. The surface of the panel 16 is roughened to prevent a music piece 39 from slipping off the cover 28 when the music piece 39 abuts on the opened cover 28.

The keyboard cover 28 has a first cover body 30 and a second cover body 31. The rear end of the first cover body 30 is supported at the upper positions of the inner surfaces of the rear end portions of the pair of side arms 11 and 12 and can be pivoted in the back-and-forth (vertical) direction. The rear end of the second cover body 31 is pivotally coupled to the front end of the first cover body 30 through hinges 33 and can be folded to its inner side. When the cover 28 is closed, the first and second cover bodies 30 and 31 cover the keyboards 20 and 21 above the panels 16 and 17. However, while the cover 28 is being opened, a state indicated by the solid line in FIG. 1 is changed to a state (indicated by a broken line) wherein the hinges 33 are bent, and then to a state wherein distal ends 43 and 45 of the second cover 31 are fitted in a lock portion 46 of a notched portion 52. In other words, as indicated by a solid line 35 in FIG. 2, the cover 28 is folded and is held inclined toward the upper end of the rear surface of the musical instrument housing 7. A music piece 39 stands against the exposed surface, i.e., the inner surface of the second cover body 31, so that the exposed surface serves as a music rack.

The first cover body 30 consists of a first cover member 30A, a second cover member 30B and a reinforcing member 41. The first cover member 30A is made of an opaque plastic or metal (e.g., aluminum) and has a fitting groove 40 at its front end face. The second cover member 30B is made of a transparent plastic plate (including a smoked plastic plate through which an interior can be seen) such as an acrylic plate and has a rear end fixed with screws in the fitting groove 40. The reinforcing member 41 is formed as a substantially U-shaped member by an extrusion process and is fixed with screws at the front end of the second cover member 30B. The rear end of the first cover member 30A is pivotally fixed between the pair of side arms 11 and 12. The front end portion of the first cover member 30A is bent downward at substantially the same angle as that of the panel 17, so that the second cover member 30B is located opposite and parallel to the panel 17. The second cover body 31 is made of a transparent plastic plate such as an acrylic plate, and its front and rear ends are fixed to reinforcing members 43 and 44 of a substantially U-shaped cross section. The reinforcing members 43 and 44 are made of aluminum in an extrusion process. Hook-like engaging portions 45 are integrally suspended from both ends of the lower surface of the front reinforcing member 43 and have lower ends bent backward. Lock portions 46 are respectively formed at the rear side portions of the upper end faces of the side arms 11 and 12 so as to correspond to the engaging portions 45. When the cover 28 is open, the lock portions 46 are respectively engaged with the engaging portions 45 to prevent backward movement of the reinforcing member 43. The lock portions 46 respectively comprise V-shaped grooves. Projections 47 are formed at the rear end portions of the V-shaped grooves so as to cover the grooves. The engaging portions 45 respectively engage with the projections 47 from the lower side.

The hinges 33 are mounted at predetermined intervals across the lower surfaces of the reinforcing members 41 and 44 along the longitudinal direction. Torsion coil springs 33A are mounted on the hinges 33 to apply a force to open the keyboard cover 28, i.e., lift a portion coupling the first and second cover bodies 30 and 31. The above structure is constructed in the following manner. The torsion coil springs 33A are respectively mounted on the shafts of the hinges 33, and both ends of the springs 33A are inserted between the corresponding hinges 31 and the reinforcing members 41 and 44.

Guide projections or stepped portions 50 are formed on the inner side surfaces of the upper covers 18 and 19 fixed to the upper end faces of the side arms 11 and 12. The guide projections 50 support both edges of the keyboard cover 28 when it is closed. The guide projections 50 guide the reinforcing member 43, that is, the member 43 slides over the guide projections 50 along the overall or substantial length (excluding a portion correspond to the lock portions 46) of the back-and-forth direction while the cover 28 is being opened and closed. The front end portions of the guide projections 50 which correspond to the panel 17 are inclined downward substantially at the same angle as that of the panel 17. The rear end portions of the guide projections 50 are substantially horizontal. The rear end edges are formed to have a shape suitable for guiding the distal end of the second cover body 31 to the recessed portion 52. When the keyboard cover 28 is closed, the engaging portions 45 of the reinforcing member 43 are stably opposite to the front end faces of the guide projections 50 at extended positions of the guide projections 50. It should be noted that the downward inclination of the second cover body 31 toward the front increases the effect of the torsion coil springs 33A. In other words, if the first and second cover bodies 30 and 31 are located on the same plane, the level of the coupling portion therebetween is lowered to cancel the effect of the torsion coil springs 33A.

In the closed state, when the front end of the second cover body 31 is slightly lifted to place the engaging portions 45 of the reinforcing member 43 on the upper surfaces of the front ends of the guide projections 50 and are moved backward along the guide projections 50, the first cover body 30 is pivoted about a bearing 101 clockwise (upward) in FIG. 1. The coupling portion between the first and second cover bodies 30 and 31 is gradually moved upward due to the action of the hinges 33 and is then folded to engage the engaging portions 45 with the lock portions 46, thereby holding the keyboard cover 28 in an open position, i.e., a folded state, as indicated by the solid line 35 in FIG. 2. Therefore, the outer surface of the second cover body 31 faces forward and serves as a music rack, as described above.

Since the torsion coil springs 33A apply a force to the keyboard cover 28 in an open direction, the coupling portion between the first and second cover bodies 30 and 31 can be easily bent with a small force, thereby easily opening the keyboard cover 28. However, when the keyboard cover 28 is to be closed, the torsion coil springs 33A act against the force for opening the keyboard cover 28, thereby preventing rapid closing of the keyboard cover 28. The outer surface of the panel 16 comprises a rough surface as described before, and its front end is inclined backward and serves as a music rack for a musical piece 39. When the cover 28 is open, a sufficient space is formed to insert a finger between the front end of the keyboard cover 28, i.e., the reinforcing member 43 and the upper panel 16. When the player wishes to close the cover, he inserts fingers in this space and pulls the reinforcing member 43 toward himself, thereby easily closing the keyboard cover 28. Since a sufficient space is assured between the reinforcing member 43 and the lower front rail 14, the player does not accidentally clamp his fingers therebetween.

Figure 3:
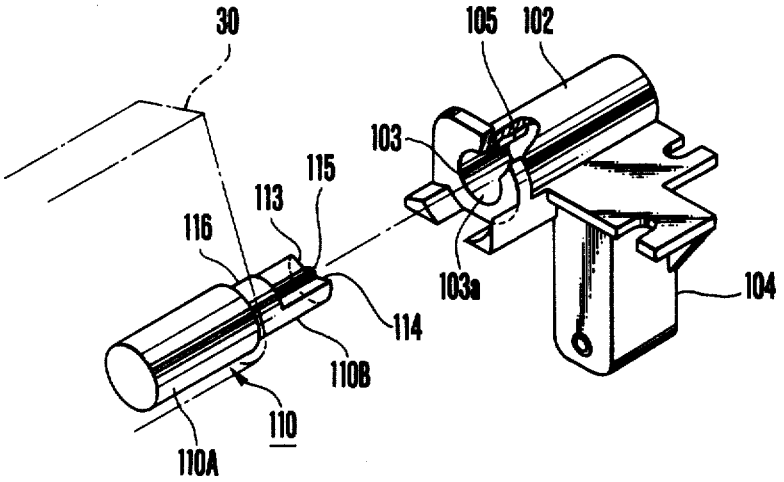
FIG. 3 is a developed view showing a bearing structure of a keyboard cover.

In the above embodiment, the keyboard cover 28 is held at a predetermined angle and is prevented from lying down. For this purpose, the engaging and lock portions 45 and 46 are utilized to lock the keyboard cover 28. At the same time, the reinforcing member 43 is stopped by a rear end face **52*a* of the notched portion 52 formed in the guide projections 50 corresponding to the lock members 46**. However, a proper stopper member may be used to prevent backward pivotal movement of the first cover body 30. Alternatively, as shown in FIG. 3, the shafts at the two sides of the rear end portion of the first cover body 30 can be regulated by corresponding bearings.

Figure 4:
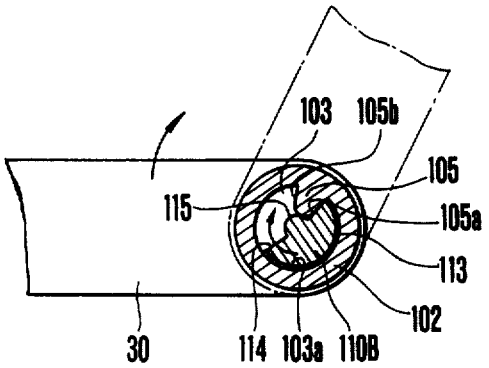
FIG. 4 is a sectional view of the bearing structure.

The above arrangement will be described in detail. Referring to FIGS. 3 and 4, reference numeral 101 denotes a bearing which is integrally formed by a plastic material and which is fixed with screws to the stationary portion of the housing. The bearing 101 has a cylindrical portion 102 with a shaft hole 103 and a stationary portion 104 fixed to the musical instrument frame. An axially elongated projection 105 is formed on the surface (i.e., a shaft support surface 103*a*) of the hole 103 and extends from a relatively inner position with respect to the opening end of the hole 103 to a deeper position. The distal end face of the projection 105 is constituted by a smooth arcuated surface.

A shaft 110 supported by the bearing 101 comprises a plastic integral body consisting of a proximal portion 110A embedded in the pivot portion of the pivotal member, i.e., the first cover body 30 and fixed by a female screw to be free from rotation, and a shaft portion 110B inserted in the hole 103 and extending laterally from the first cover 30. The insertion side of the shaft portion 110B has a substantially semicircular cross section, so that the shaft portion 110B has two axially elongated surfaces 113 and 114. An axially elongated projection 115 is located at the boundary between the surfaces 113 and 114 and integrally extends therefrom. The projection 115 is formed in correspondence with the projection 105 and extends for substantially the same length as that of the projection 105. A smooth arcuated surface constitutes a distal end portion of the projection 115 toward its center. The projection 115 is always in linear contact (or is adjacent to) with the distal end face of the projection 105, thereby eliminating radial play of the shaft 110.

The cross sectional view of the insertion side of the shaft portion 110B is determined by a maximum allowable pivot angle of the cover body 30. When the pivot angle is decreased, the cross sectional shape approximates a circle. However, when the pivot angle is increased, the shape approximates a sector shape with a small central angle. The cross sectional shape of an end portion 116 located opposite to the insertion end of the shaft portion 110A is circular. The end portion 116 is inserted in the hole 103 to eliminate a play of the shaft 110.

In the bearing structure with the construction described above, when the first cover body 30 is closed as indicated by the solid line in FIG. 4, i.e., substantially horizontal, the surface 113 abuts against a right surface 105*a* of the projection 105 to prevent counterclockwise pivotal movement of the first cover body 30. However, when the first cover body 30 is pivoted clockwise by a predetermined angle, the shaft 110 is pivoted together with the first cover body 30. In this state, the surface 114 abuts against a left surface 105*b* of the projection 105, thereby preventing the first cover body 30 from further clockwise pivotal movement. As a result, the pivotal movement of the first cover body 30 is regulated by the bearing structure itself. An additional stopper mechanism need not be arranged. In addition, the bearing structure itself is very simple, and the surface contact between the surface 113 or 114 and the projection 105 regulates pivotal movement of the first cover body 30. Therefore, even if considerably large return moments and impact force are applied to the first cover body 30, the shaft 110 or the projection 105 will not be damaged. As a result, the bearing 101 and the shaft 110 can be made of plastic. In addition, cooperation of the engaging, lock and notched portions 45, 46, and 52 allows stable holding of the keyboard cover 28.

Figure 5:
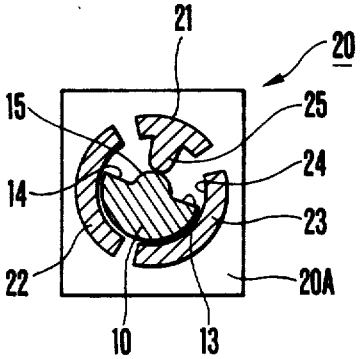
FIG. 5 is a sectional view showing a modification of the bearing structure.

FIG. 5 is a sectional view showing a modification of the bearing structure according to the present invention. Three arcuated projection walls 121, 122, and 123 having an identical radius are formed on a proximal portion 120A of a bearing 120 such that the inner surfaces of the walls 121, 122, and 123 are aligned on a single circle. The inner surfaces of the projection walls 121, 121, and 123 constitute a shaft support surface 124 for supporting the shaft 110. An elongated projection 125 is integrally formed with one of the projection walls to extend along the axial direction (i.e., a direction perpendicular to the drawing of FIG. 5). The shaft 110 is the same as that in the above embodiment. The same reference numerals as in the modification denote the same parts in the embodiment, and a detailed description thereof will be omitted. With this arrangement, the shaft 110 can be stably supported in the same manner as in the above embodiment, and the pivotal angle of the first cover body 30 can be regulated.

Figure 6:
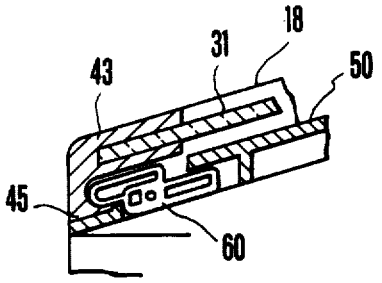
FIGS. 6 and 7 are a side sectional view and a plan view, respectively, of a lock mechanism when the keyboard cover is closed.
Figure 7:
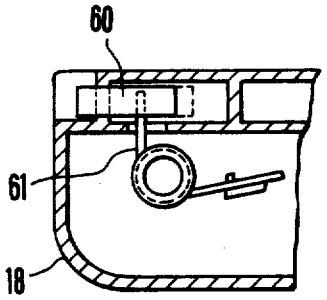

In order to lock the keyboard cover 28 while it is open, engaging projections may be formed on the front end faces of the guide projections 50, and the engaging portions 45 of the reinforcing member 43 are elastically engaged with the engaging projections. Alternatively, as shown in FIGS. 6 and 7, a back-and-forth movable member 60 is formed on an inner surface of the front end of an upper cover 18 or 19 (or the upper covers 18 and 19), and the lock member 60 urges a spring 61 to cause the front end of the lock member 60 to engage with the engaging portion 45 from the back side when the keyboard cover is closed. In this case, part of the lock member 60 is inserted in the upper cover 18 and will not be removed toward the front side.

In the keyboard cover 28 with the arrangement described above, since a second cover body 31 stands on a musical instrument housing 7 such that the outer surface of the body 31 faces outward, the inner surface of the body 31 cannot be seen by the player, thus providing good appearance. When the first cover body 30 is made of wood, the inner surface can be treated at less cost than the outer surface. In addition, since the second cover body 31 also serves as a music rack, a separate music rack need not be arranged independently of the cover body, thereby further simplifying the musical instrument itself. Furthermore, since the keyboard cover 28 can be opened/closed along the guide projections 50, a large operation force is not required. In addition, the player's fingers are not accidentally clamped between the second cover body 31 and the lower front rail 14. Even children can safely open or close the keyboard cover 28.

Furthermore, the torsion coil springs 33A are mounted on the corresponding hinges 33 to decrease the apparent weight of the keyboard cover 28, thereby allowing easy opening/closing of the keyboard cover 28. Furthermore, even if the player releases the keyboard cover 28 while it is closed, it does not bang. Therefore, even children can be safely handle the keyboard cover 28.

As described in detail with reference to FIGS. 6 and 7, when the keyboard cover 28 is locked by the engaging and lock portions 45 and 46, additional members such as stays can be eliminated, but the keyboard cover 28 can be stably and properly locked. Vibration of the keyboard cover 28 which is caused by turn-over of musical piece pages and resonance with musical tones, noise generation, and backward fall can be completely prevented while the keyboard cover 28 is open. When the keyboard cover 28 is closed and is locked by the lock member 60, as shown in FIG. 7, loosening during transportation can be prevented.

Figure 8:
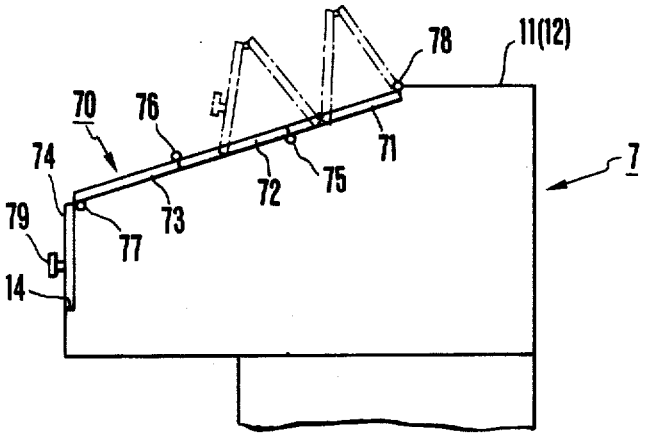
FIG. 8 is a side view showing another embodiment of the present invention.

FIG. 8 is another embodiment of the present invention. In this embodiment, a keyboard cover 70 is constituted by four cover bodies 71, 72, 73, and 74. The cover bodies 71, 72, 73, and 74 are coupled through hinges 75, 76 and 77 such that the folding directions are opposite to each other in each two adjacent cover bodies. When the keyboard cover 70 is closed, the front and upper sides of the keyboard section are covered by the keyboard cover 70. However, when the keyboard cover 70 is open, the cover bodies 71, 72, 73, and 74 are folded substantially in an inverted W shape. In this case, the rearmost cover body 71 constitutes a first cover body since the rear end of the body 71 is pivotally supported between a pair of side arms 11 and 12 through a shaft (or hinges) along the back-and-forth (vertical) direction. The frontmost cover body 74 constitutes the second cover member since the outer surface stands inclining backward and the body 74 serves as a music rack when the cover 70 is open. In other words, the first cover body 30 in the first embodiment is divided into three pieces to constitute the first cover body of the second embodiment. That is, the first and second cover bodies 71 and 74 are coupled through the two cover bodies 72 and 73.

Although not described in the second embodiment, the keyboard cover 70 can be opened/closed along the guide projections formed on the inner side surfaces of the side arms 11 and 12 in the same manner as in the first embodiment. When the cover body 74 is closed, its front end face is in contact with the lower front rail 14 to cover the front surface of the musical instrument housing 7. In order to easily close/open the keyboard cover 70, a long handle 79 extending along the right-and-left direction is mounted on the outer surface of the cover body 74. The handle 79 also serves as a music rack when the keyboard cover 70 is open. The number of cover bodies between the first and second cover bodies 71 and 74 is not limited to 2 but can be any even number.

Figure 9:
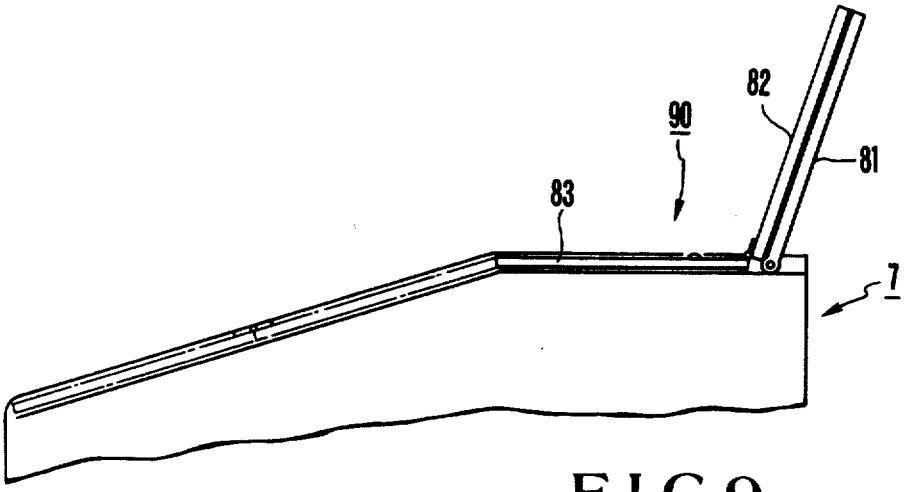
FIG. 9 is a side view showing still another embodiment of the present invention when the keyboard cover is open.

FIG. 9 shows still another embodiment of the present invention. In this embodiment, a keyboard cover 80 is constituted by first, second and third cover bodies 81, 82 and 83 which are coupled in a foldable manner. When the keyboard cover 80 is open, the first and second cover bodies 81 and 82 are folded so that their inner surfaces are brought into contact with each other. At the same time, the folded first and second cover bodies 81 and 82 are inclined backward at a predetermined angle and held thereat. The third cover body 83 is held substantially horizontal. In this case, the first and second cover bodies 81 and 82 correspond to the first and second cover bodies 30 and 31 in the first embodiment.

Figure 10:
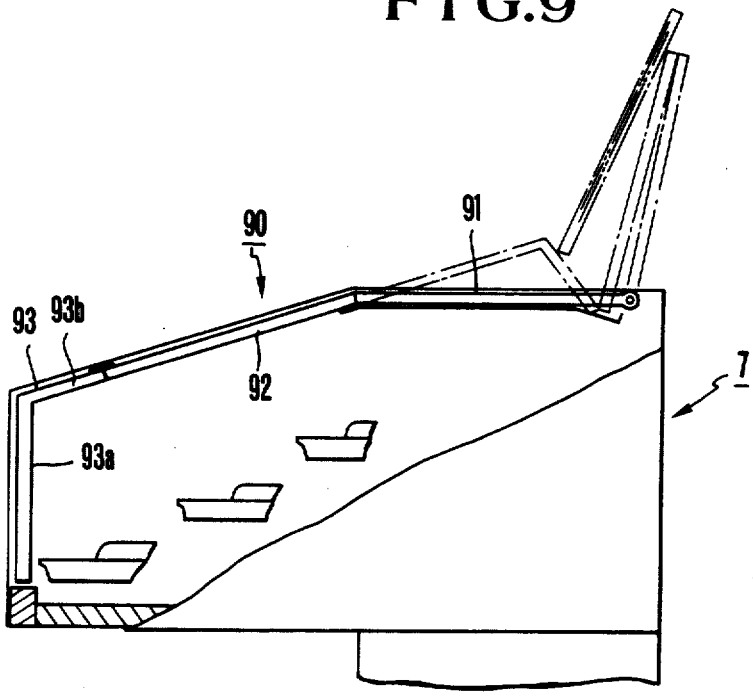
FIGS. 10 and 11 are side sectional views showing still another embodiment of the present invention.

FIG. 10 shows still another embodiment of the present invention. In this embodiment, a keyboard cover 90 is constituted by first, second and third cover bodies 91, 92 and 93 in the same manner as in the embodiment of FIG. 9. However, unlike in the embodiment of FIG. 9, the third cover body 93 is bent in a substantially hook shape, and its front end portion 93*a* covers the front surface of the musical instrument housing 7. When the keyboard cover 90 is open, the third cover body 93 is held substantially horizontal. A rear end portion 93*b* of the third cover body 93 is inclined backward and serves as a music rack.

Figure 11:
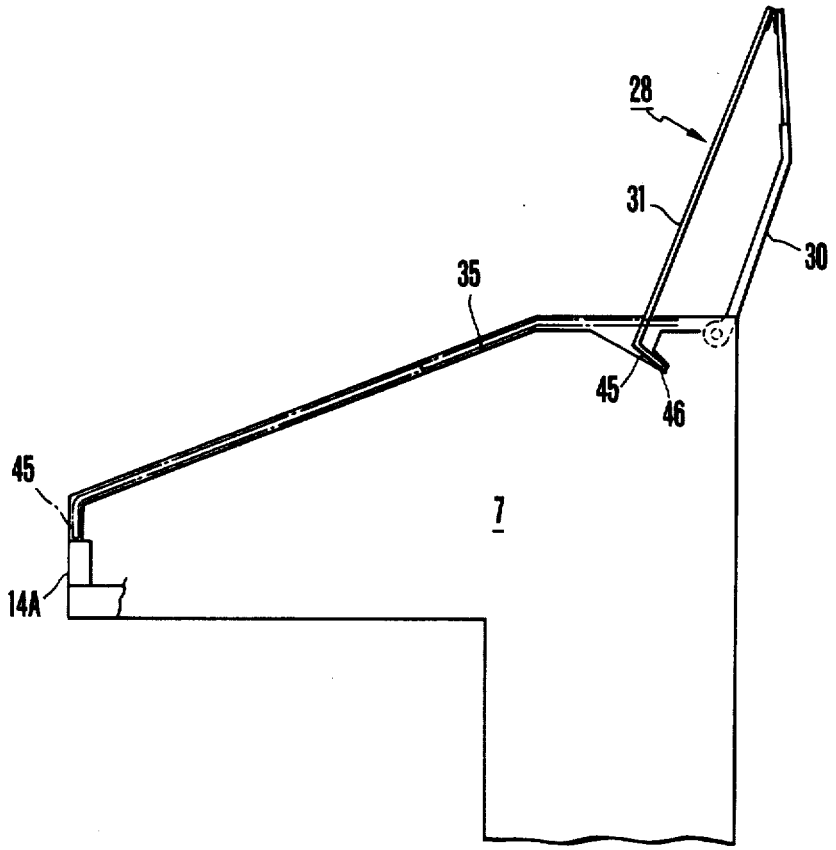

FIG. 11 shows still another embodiment of the present invention. In this embodiment, the front end portion of a second cover body 31 is bent downward and serves as an engaging portion 45A. The engaging portion 45A is inserted in a lock portion 46 formed in a musical instrument housing 7 to lock a keyboard cover 28 when it is open. When the keyboard cover 28 is closed, the lower end of the engaging portion 45A is in contact with the upper surface of a lower front rail 14A to cover the front surface of the musical instrument housing 7. Other arrangements of this embodiment are the same as those of the embodiments described above.

The present invention is not limited to the particular embodiments described above. Various changes and modifications may be made within the spirit and scope of the invention. For example, referring to FIG. 1, the roughened surface may be formed on part of the panel 16. The roughened surface and the upper surface of the folded second cover body cooperate to constitute a music rack, so that a music piece can stably stand against the music rack.

What is claimed is

1. A housing assembly of an electronic musical instrument with a keyboard, comprising:

a musical instrument housing with said keyboard and an operation panel located adjacent to said keyboard; and a cover for covering said keyboard and said operation panel, said housing assembly further being provided with guides located at two sides of said keyboard and said operation panel of said musical instrument housing, said cover being constituted by first and second cover bodies, a first coupling device for coupling said first and second cover bodies in a foldable manner, and a second coupling device for pivotally coupling a rear end portion of said first cover body to said musical instrument housing, said second cover being adapted such that a front end portion thereof is moved along said guides while said cover is opened/closed, and said second cover being adapted such that an outer surface thereof stands facing forward and serves as a music rack when opened.

2. An assembly according to claim 1, wherein said second coupling device comprises bearing units mounted between said musical instrument housing and said rear end portion of said first cover body, each bearing unit being provided with a mechanism for regulating pivotal movement of a corresponding shaft.

3. An assembly according to claim 2, wherein said each bearing unit comprises a bearing with a projection portion formed on a shaft support surface along an axial direction thereof, and a shaft with a sliding surface slidably contacting said shaft support surface and a projection brought into contact with said projection portion so that pivotal movement of said projection portion is regulated.

4. An assembly according to claim 3, wherein said bearing comprises a plurality of arcuated segments located such that inner surfaces thereof are located on a single circle.

5. An assembly according to claim 1, wherein said first coupling device comprises a hinge unit.

6. An assembly according to claim 5, wherein said hinge unit includes a spring for applying a force to said first and second cover bodies so as to open said cover.

7. An assembly according to claim 1, wherein said front end portion of said second cover includes a lock portion formed on an inner surface of at least one of side boards of said musical instrument housing and an engaging portion engaged with said lock portion when said cover is closed.

8. An assembly according to claim 7, wherein said lock portion comprises a back-and-forth movable mechanism which causes said spring to bias said lock portion so as to engage with said engaging portion of said second cover body.

9. An assembly according to claim 1, wherein said cover comprises at least three cover bodies and a plurality of first coupling devices coupling said cover bodies in a foldable manner.

10. An assembly according to claim 1, wherein a surface region of said operation panel which is adjacent to said front end portion of said second cover body and which is located below and in front of said second cover body when said cover is open is roughened, a lower end of a music piece being placed on said surface region.

11. An assembly according to claim 10, wherein said front end portion of said second cover body is locked by a holding member located behind said operation panel when said cover is opened.

12. An assembly according to claim 1, wherein said second cover body is made of a material through which at least part of an interior of said assembly can be seen.

* * * * *

UNITED STATES PATENT AND TRADEMARK OFFICE

CERTIFICATE OF CORRECTION

PATENT NO. : 4,656,913

DATED : 4/14/87

INVENTOR(S) : YOSHIKAWA

It is certified that error appears in the above-identified patent and that said Letters Patent is hereby corrected as shown below:

| COLUMN | LINE | DESCRIPTION |
|---|---|---|
| 6 | 13 | delete "121", second occurrence, insert -- 122 --. |
| 8 | 10 | delete "instrumei.+" and insert -- instrument --. |

Signed and Sealed this

Fifth Day of July, 1988

*Attest:*

*Attesting Officer*

DONALD J. QUIGG

*Commissioner of Patents and Trademarks*